US006930566B2

(12) United States Patent
Koseki et al.

(10) Patent No.: US 6,930,566 B2
(45) Date of Patent: Aug. 16, 2005

(54) SMALL NONRECIPROCAL CIRCUIT ELEMENT THAT CAN BE EASILY WIRED

(75) Inventors: Masahiko Koseki, Fukushima-ken (JP); Yoshito Konno, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 123 days.

(21) Appl. No.: 10/337,141

(22) Filed: Jan. 6, 2003

(65) Prior Publication Data

US 2003/0128078 A1 Jul. 10, 2003

(30) Foreign Application Priority Data

Jan. 7, 2002 (JP) ..... 2002-000867

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS 6,580,148 B2 * 6/2003 Hasegawa et al. ..... 257/533
2001/0054936 A1 * 12/2001 Okada et al. ..... 333/1.1

FOREIGN PATENT DOCUMENTS

JP 2002-261513 9/2002

* cited by examiner

*Primary Examiner*—Stephen E. Jones
(74) *Attorney, Agent, or Firm*—Brinks Hofer Gilson & Lione

(57) ABSTRACT

A nonreciprocal circuit element of the present invention comprises a first yoke and a second yoke that form a magnetic closed circuit. A plurality of chip capacitors with a first electrode and a second electrode are installed in the box-shaped second yoke. Subsequently, a circuit substrate used for the nonreciprocal circuit element can be smaller than conventional circuit substrates, and the assembly of the nonreciprocal circuit element is excellent. Further, since the capacitances of the chip capacitors can be adjusted through windows of the second yoke, the electrical performance of the nonreciprocal circuit element is excellent.

10 Claims, 6 Drawing Sheets

SMALL NONRECIPROCAL CIRCUIT ELEMENT THAT CAN BE EASILY WIRED

This application claims the benefit of priority to Japanese Patent Application 2002-000867, filed on Jan. 7, 2002.

BACKGROUND OF THE INVENTION

1. Field of the Invention

The present invention relates to a nonreciprocal circuit element such as a circulator, an isolator, and so forth that can be used for an antenna multiplexer or the like.

2. Description of the Related Art

The configuration of a typical known nonreciprocal circuit element S2 will be described with reference to FIGS. 7, 8, and 9. The nonreciprocal circuit element S2 includes three central conductors 51. Each of the three central conductors 51 is formed as a metal plate. The three metal plates cross one another and are provided in a hundred-and-twenty degree intervals. The nonreciprocal circuit element S2 further includes a dielectric substrate 52 comprising a dielectric material. The dielectric substrate 52 is molded so that each of the three central conductors 51 is partly imbedded into it. The nonreciprocal circuit element S2 further includes a magnet 53 placed on the three central conductors 51 at the position where they cross one another and a circular ferrite plate 58 placed under the three central conductors 51 at the position where they cross one another. The nonreciprocal circuit element S2 further includes a first yoke 54 formed as a magnetic plate. The first yoke 54 is provided so as to cover the magnet 53, which is placed on the three central conductors 51. The nonreciprocal circuit element S2 further includes a second yoke 55 formed as a magnetic plate with a bottom. The second yoke 55 is provided so as to cover the ferrite plate 58, which is placed under the three central conductors 51. The second yoke 55 is connected to the first yoke 54.

Accordingly, in the nonreciprocal circuit element S2, the first yoke 54 and the second yoke 55 form a magnetic closed circuit. Each of the central conductors 51 has an input/output terminal 51*a*. The three input/output terminals 51*a* are protruding from the side of the first yoke 54 and the second yoke 55, which are connected with each other.

A circuit substrate 56 shown in FIG. 8 can be used for an antenna multiplexer or the like. The circuit substrate 56 has a hole 56*a*, a plurality of conductive patterns 57, and a plurality of chip capacitors C2 that are provided around the hole 56*a*.

The configuration of the chip capacitor C2 is shown in FIG. 9. The chip capacitor C2 includes an insulator 61 formed as a ceramic rectangular parallelepiped or the like. The chip capacitor C2 further includes a first electrode 62 and a second electrode 63 that are made of silver or the like. The first and second electrodes 62 and 63 are provided on two flat opposing surfaces of the insulator 61, respectively. A capacitance is formed between the opposing first and second electrodes 62 and 63.

Thus, various electrical parts (not shown) including the plurality of chip capacitors C2 or the like that is to be connected to the nonreciprocal circuit element S2 are provided on the circuit substrate 56, which has the conductive patterns 57 thereon. Subsequently, a desired electronic circuit is formed.

The nonreciprocal circuit element S2 is placed in the hole 56*a* of the circuit substrate 56. Then, the three input/output terminals 51*a* each having a ground electrode (not shown) are provided on the conductive patterns 57. The three input/output terminals 51*a* are soldered to the conductive patterns 57 so that they are connected to one another.

After that, either the first electrode 62 or the second electrode 63 of the chip capacitor C2 is cut out so that the capacitance is adjusted. Subsequently, a desired electrical characteristic is obtained.

Thus, the nonreciprocal circuit element S2 is mounted on the circuit substrate 56, which has the chip capacitors C2 thereon. Therefore, the circuit substrate 56 increases in size. Further, the nonreciprocal circuit element S2 and the chip capacitors C2 have to be separately wired to the circuit substrate 56. Accordingly, the workability of the nonreciprocal circuit element S2 is worsened.

SUMMARY OF THE INVENTION

Accordingly, it is an object of the present invention to provide a small nonreciprocal circuit element that can be easily wired.

According to an aspect of the present invention, a nonreciprocal circuit element comprises a flat-shaped ferrite material, and first, second, and third central conductors that are provided on one another sandwiching dielectrics and that are crossing one another. The first, second, and third central conductors are provided on the ferrite material. The nonreciprocal circuit element further comprises a magnet provided on the first to third central conductors, a box-shaped first yoke covering the magnet, and a box-shaped second yoke provided under the ferrite material for forming a magnetic closed circuit with the first yoke. The nonreciprocal circuit element further comprises a plurality of chip capacitors with a first electrode and a second electrode. The plurality of chip capacitors is installed in the second yoke. One of the first electrodes and the second electrodes is electrically connected to the second yoke, and the other is electrically connected to the central conductors. The second yoke has at least one window for exposing the one of the first electrodes and the second electrodes. The one of the first electrodes and the second electrodes can be cut out through the window.

Thus, the chip capacitors are installed in the second yoke. Therefore, the nonreciprocal circuit element can be installed on a circuit substrate smaller than conventional circuit substrates.

When the nonreciprocal circuit element is mounted on the circuit substrate, the chip capacitors can also be connected to conductive patterns of the circuit substrate. Thus, the assembly of the nonreciprocal circuit element is easier than that of conventional nonreciprocal circuit elements.

Further, the capacitances of the chip capacitors can be adjusted through the at least one window of the second yoke. Therefore, the nonreciprocal circuit element has good electrical performance.

Preferably, the one of the first electrodes and the second electrodes is soldered to the second yoke and the other is soldered to the central conductors. Therefore, the assembly of the nonreciprocal circuit element becomes good. Further, when adjusting the capacitances of the chip capacitors, the chip capacitors are not detached from the second yoke.

Preferably, the one of the first electrodes and the second electrodes, which is soldered to the second yoke, is exposed at the window. Therefore, the electrodes that are firmly stuck and grounded can be cut out. Further, the chip capacitors are not detached from the second yoke.

Preferably, the second yoke has a base and a sidewall extending from the base in a direction perpendicular to the base, and the one of the first electrodes and the second electrodes may be soldered to the sidewall. Subsequently, the chip capacitors can be easily adjusted and terminals of the one of the first electrodes and the second electrodes can be drawn out through the at least one window.

Preferably, the second yoke has a base and a sidewall extending from the base in a direction perpendicular to the base, and the one of the first electrodes and the second electrodes may be soldered to the base. Subsequently, the chip capacitors can be easily installed in the second yoke.

Preferably, a magnet is installed in the first yoke so that a first block is formed. Further, the plurality of chip capacitors, the ferrite material, and the central conductors may be installed in the second yoke so that a second block is formed. Then, the first and second blocks may be combined together. In such a case, the two blocks can be assembled separately and excellently. Further, the nonreciprocal circuit element can be formed by assembling the two blocks. Therefore, the productivity of the nonreciprocal circuit element is excellent.

DESCRIPTION OF THE PREFERRED EMBODIMENTS

Figure 1:
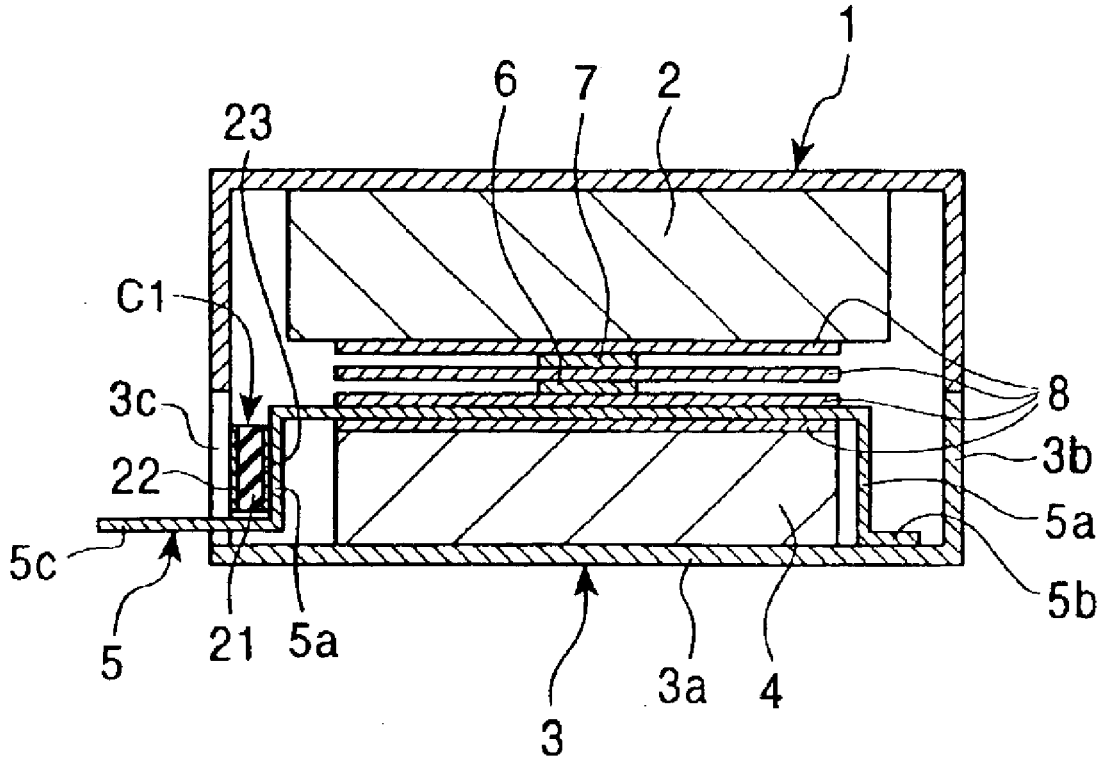
FIG. 1 is an enlarged cross-sectional view of the main part of a nonreciprocal circuit element according to a first embodiment of the present invention.
Figure 2:
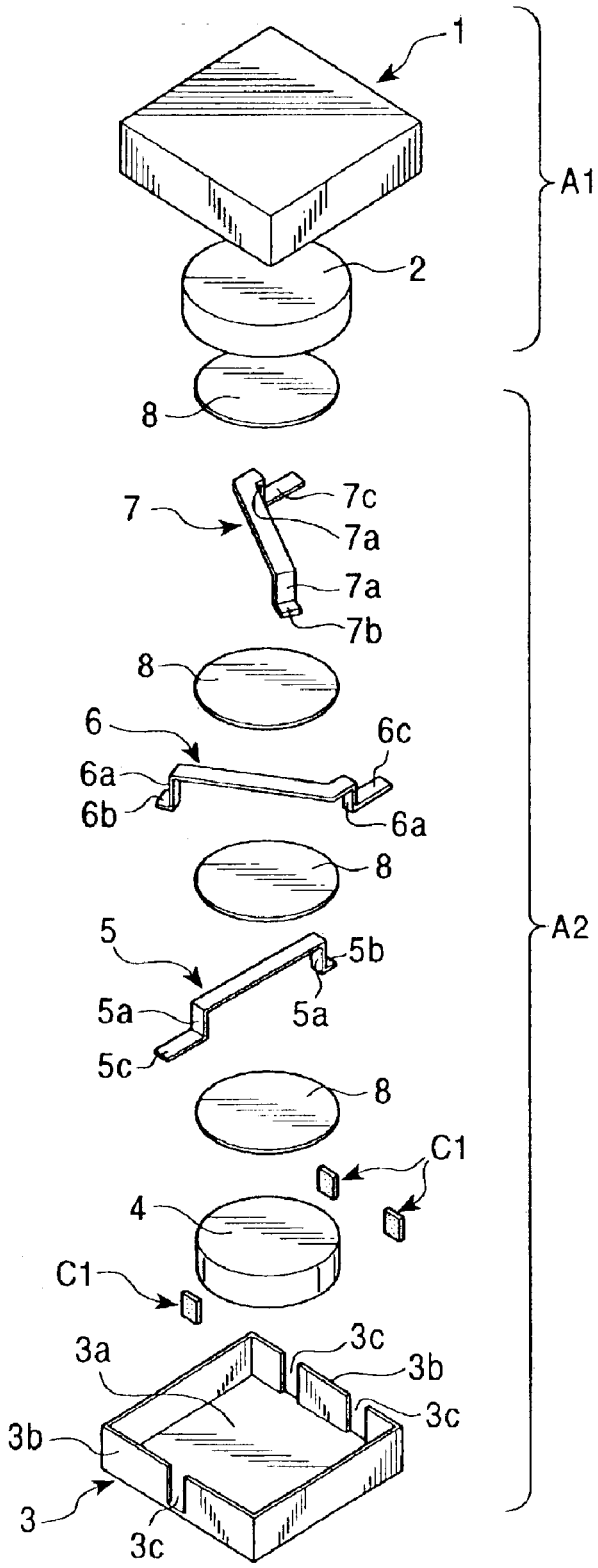
FIG. 2 is an exploded perspective view of the nonreciprocal circuit element according to the first embodiment of the present invention.
Figure 3:
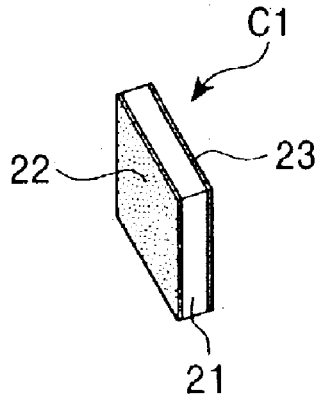
FIG. 3 is a perspective view of a chip capacitor relating to the nonreciprocal circuit element according to the first embodiment of the present invention.

The configuration of a nonreciprocal circuit element according to a first embodiment of the present invention will be described with reference to FIGS. 1 to 3. The nonreciprocal circuit element includes a first yoke 1. The first yoke 1 is formed as a box made of a magnetic plate (an iron plate or the like). A magnet 2 is installed in the first yoke 1 by using an adhesive or the like. Subsequently, a first block A1 is formed.

Further, the nonreciprocal circuit element includes a second yoke 3 formed as a box made of a magnetic plate (an iron plate or the like). The second yoke 3 has a base plate 3*a* and four side plates 3*b* on four sides of the base plate 3*a*. The four side plates 3*b* are bent in a direction perpendicular to the base plate 3*a*. One opposing pair of the four side plates 3*b* have a plurality of (three) windows 3*c*. The windows 3*c* are formed by cutting or the like.

Further, the nonreciprocal circuit element includes a flat-shaped ferrite material 4 made of YIG (Yttrium Iron Garnet) or the like. The ferrite material 4 is installed on the base plate 3*a* of the second yoke 3.

The nonreciprocal circuit element includes three chip capacitors C1. The configuration of one of the chip capacitors C1 is shown in FIG. 3. As shown in the drawing, the chip capacitor C1 includes an insulator 21 made of a ceramic plate or the like. The chip capacitor C1 further includes a first electrode 22 and a second electrode 23 that are made of silver or the like. The first and second electrodes 22 and 23 are provided on two flat opposing surfaces of the insulator 21, respectively. A capacitance is formed between the opposing first and second electrodes 22 and 23.

The first electrode 22 is soldered to one of the side plates 3*b* so that the first electrode 22 faces one of the windows 3*c*. Subsequently, the chip capacitor C1 is installed and connected to the second yoke 3. Similarly, the other two chip capacitors C1 are installed and connected to the second yoke 3.

According to the above-described configuration, the first electrodes 22 are exposed at the windows 3*c*. Therefore, the electrodes 22 can be cut out through the widows 3*c*.

The nonreciprocal circuit element further includes a first central conductor 5, a second central conductor 6, and a third central conductor 7. Each of the central conductors 5, 6, and 7 is formed as a conductive plate made of copper or the like. The first central conductor 5 has a pair of bending parts 5*a*. One of the bending parts 5*a* has a connecting part 5*b* and the other has an input/output terminal 5*c*. The connecting part 5*b* and the input/output terminal 5*c* are formed by bending the ends of the bending parts 5*a*. The second central conductor 6 has a pair of bending parts 6*a*. One of the bending parts 6*a* has a connecting part 6*b* and the other has an input/output terminal 6*c*. The connecting part 6*b* and the input/output terminal 6*c* are formed by bending the ends of the bending parts 6*a*. The third central conductor 7 has a pair of bending parts 7*a*. One of the bending parts 7*a* has a connecting part 7*b* and the other has an input/output terminal 7*c*. The connecting part 7*b* and the input/output terminal 7*c* are formed by bending the ends of the bending parts 7*a*.

Further, the nonreciprocal circuit element includes a first dielectric 8, a second dielectric 8, a third dielectric 8, and a fourth dielectric 8. The first central conductor 5 is provided on the first dielectric 8 and under the second dielectric 8. That is to say, the first central conductor 5 is sandwiched between the first dielectric 8 and the second dielectric 8. The second central conductor 6 is provided on the second dielectric 8 and under the third dielectric 8. That is to say, the second central conductor 6 is sandwiched between the second dielectric 8 and the third dielectric 8. The third central conductor 7 is provided on the third dielectric 8 and under the fourth dielectric 8. That is to say, the third central conductor 7 is sandwiched between the third dielectric 8 and the fourth dielectric 8. The first, second, and third central conductors 5, 6, and 7 are provided in a hundred-and-twenty degree intervals via the third and fourth dielectrics 8. Also, the first, second, and third central conductors 5, 6, and 7 cross one another via the third and fourth dielectrics 8.

The first, second, and third central conductors 5, 6, and 7 are placed on the ferrite material 4 via the first dielectric 8.

The input/output terminals 5*c*, 6*c*, and 7*c* are drawn out of the windows 3*c*. The input/output terminal 5*c* is soldered to one of the second electrodes 23 so that it is electrically connected to one of the chip capacitors C1. Similarly, the input/output terminals 6*c* and 7*c* are electrically connected to the other chip capacitors C1.

Further, the connecting parts 5*b*, 6*b*, and 7*b* are soldered to the base plate 3*a* of the second yoke 3. Subsequently, the connecting parts 5*b*, 6*b*, and 7*b* are grounded and electrically connected to the second yoke 3.

As has been described, the ferrite material 4, the three chip capacitors C1, the first to fourth dielectrics 8, and the first, second, and third central conductors 5, 6, and 7 are installed in the second yoke 3. Subsequently, a second block A2 is formed.

The magnet 2 is provided on the first, second, and third central conductors 5, 6, and 7. Then, the first and second blocks A1 and A2 are combined together, whereby the nonreciprocal circuit element of the present invention is formed.

Since the first and second yokes 1 and 3 together form a magnetic closed circuit, the nonreciprocal circuit element can be used as a circulator or an isolator.

The electrical performance of the nonreciprocal circuit element can be measured by connecting a performance-measuring device (not shown) to the nonreciprocal circuit element. During the measurement, the first electrodes 22 are cut out through the windows 3*c* of the second yoke 3. Subsequently, the capacitances of the chip capacitors C1 are adjusted so that desired electrical performance can be obtained.

The above-described nonreciprocal circuit element is mounted on a circuit substrate having conductive patterns for wiring and at least one conductive pattern for grounding thereon (not shown).

In such a case, the input/output terminals 5*c*, 6*c*, and 7*c* are soldered to the conductive patterns for wiring. Further, the base plate 3*a* of the second yoke 3 is soldered to the at least one conductive pattern for grounding.

According to the first embodiment, the capacitances of the chip capacitors C1 are adjusted after the nonreciprocal circuit element is formed. However, the capacitances of the chip capacitors C1 may be adjusted after the nonreciprocal circuit element is mounted on the circuit substrate.

Figure 4:
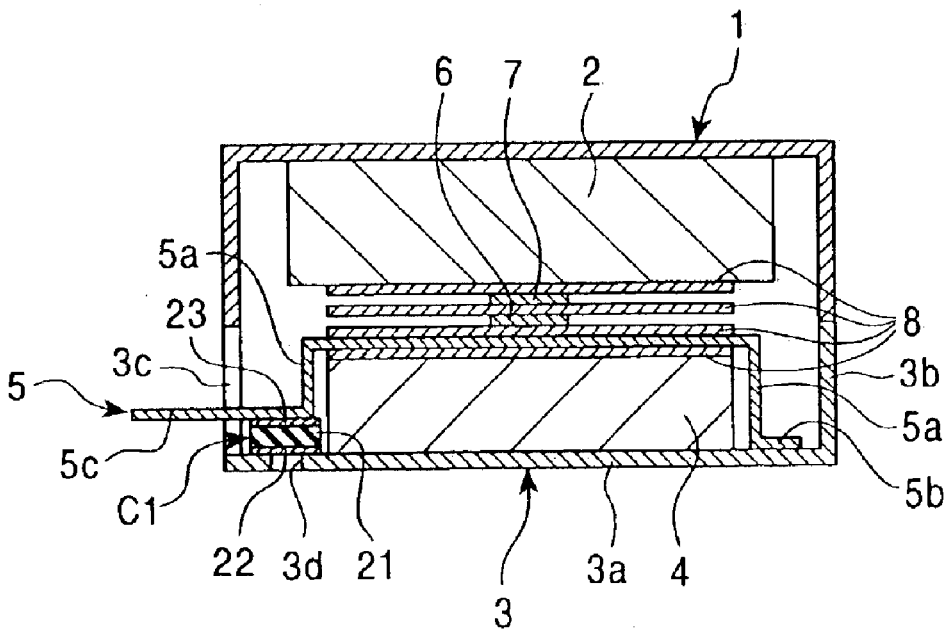
FIG. 4 is an enlarged cross-sectional view of the main part of a nonreciprocal circuit element according to a second embodiment of the present invention.

FIG. 4 is a cross-sectional view of a nonreciprocal circuit element according to a second embodiment of the present invention. According to the second embodiment, the first electrodes 22 are soldered to the base plate 3*a*. Further, the first electrodes 22 are exposed at three windows 3*d* provided at the base plate 3*a*. Therefore, the first electrodes 22 can be cut out through the windows 3*d*.

The input/output terminals 5*c*, 6*c*, and 7*c* are connected to the three second electrodes 23, respectively. Further, the input/output terminals 5*c*, 6*c*, and 7*c* protrude through the windows 3*c*.

The other configuration of the nonreciprocal circuit element is the same as that of the nonreciprocal circuit element according to the first embodiment. Therefore, the same parts are designated by the same reference numerals and characters, and the description thereof is omitted.

Figure 5:
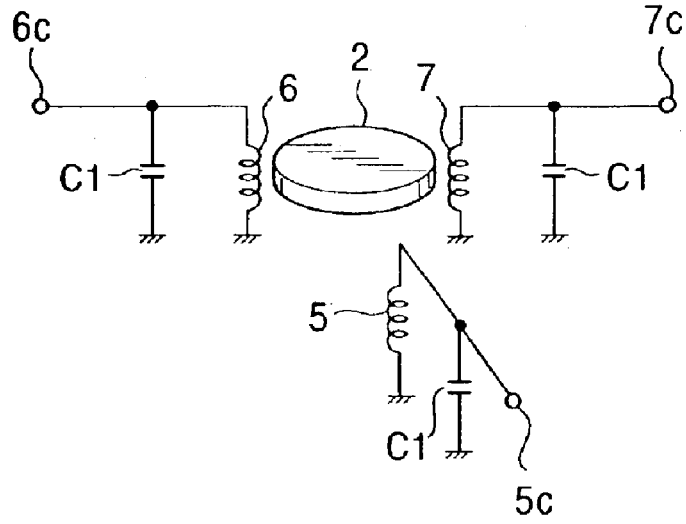
FIG. 5 is an equivalent circuit diagram of the nonreciprocal circuit element of the present invention used as a circulator.

FIG. 5 is an equivalent circuit diagram of the nonreciprocal circuit element of the present invention used as a circulator. The connecting parts 5*b*, 6*b*, and 7*b* are grounded. Further, the three chip capacitors C1 are grounded and are connected to the input/output terminals 5*c*, 6*c*, and 7*c*, respectively.

Figure 6:
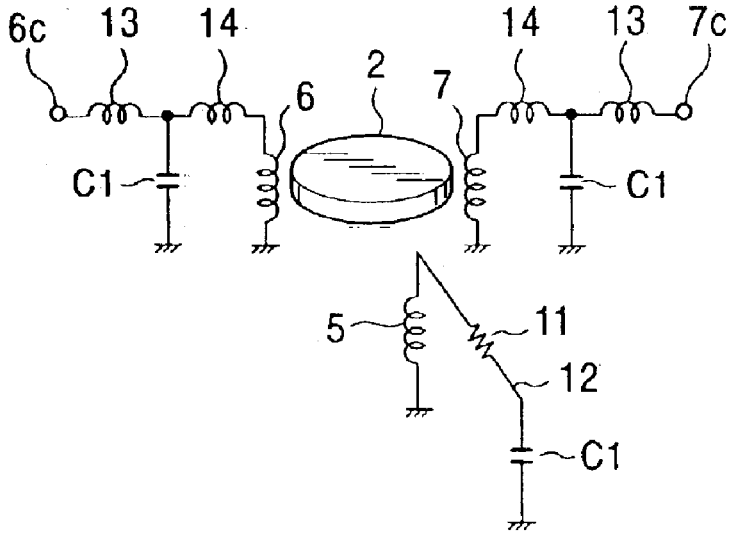
FIG. 6 is an equivalent circuit diagram of the nonreciprocal circuit element of the present invention used as an isolator.
Figure 7:
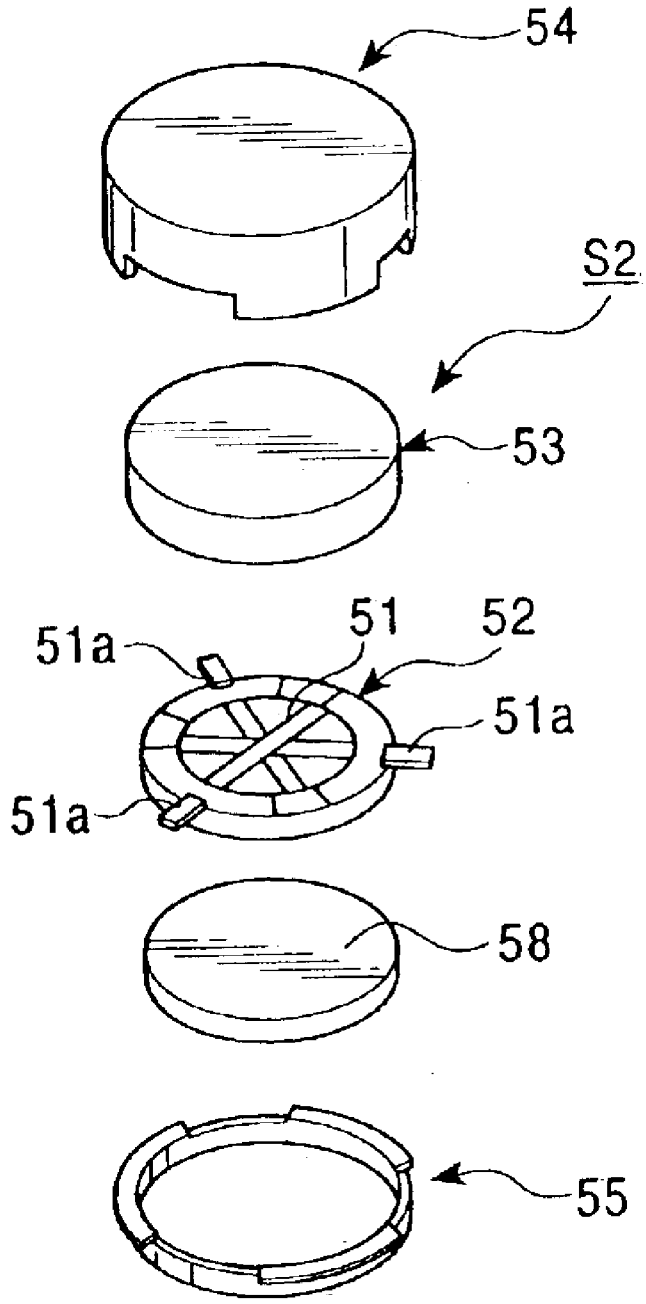
FIG. 7 PRIOR ART
FIG. 7 is an exploded perspective view of a known nonreciprocal circuit element.
Figure 8:
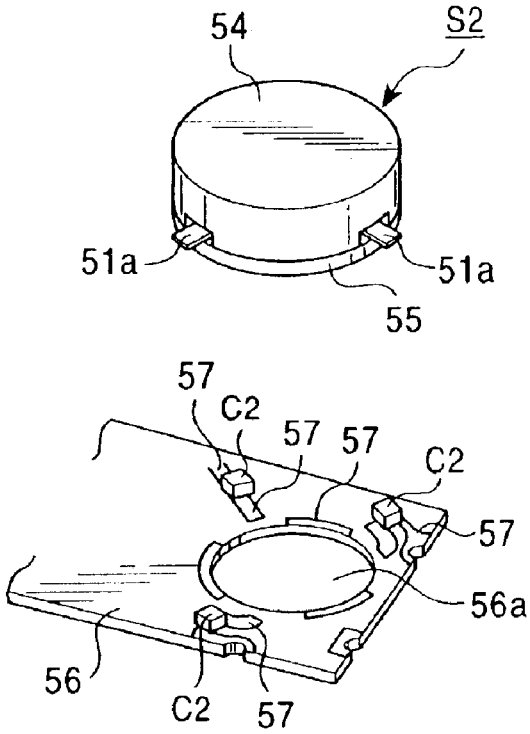
FIG. 8 PRIOR ART
FIG. 8 illustrates the installation of the known nonreciprocal circuit element.
Figure 9:
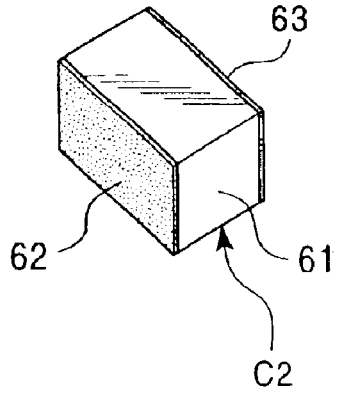
FIG. 9 PRIOR ART
FIG. 9 is a perspective view of a chip capacitor relating to the installation of the known nonreciprocal circuit element.

FIG. 6 is an equivalent circuit diagram of the nonreciprocal circuit element of the present invention used as an isolator. A resistor 11 is connected to the first central conductor 5 in series. A connecting part 12 is connected to the resistor 11. One of the chip capacitors C1 is connected to the connecting part 12. The other end of the chip capacitor C1 is grounded. Further, the connecting part 5*b* of the first central conductor 5 is grounded.

The connecting parts 6*b* and 7*b* are grounded. One end of each of the other two chip capacitors C1 is connected to the input/output terminals 6*c* and 7*c*. The other end of each of the two chip capacitors C1 is grounded.

Thus, the second and third central conductors 6 and 7 are connected to the two chip capacitors C1, respectively. Conductors on both sides of the two chip capacitors C1 are formed as inductors 13 and 14.

What is claimed is:

1. A nonreciprocal circuit element comprising:

a flat-shaped ferrite material;

first, second, and third central conductors that are provided on one another sandwiching dielectrics and that are crossing one another, the first, second, and third central conductors being provided on the ferrite material;

a magnet provided on the first to third central conductors;

a box-shaped first yoke covering the magnet;

a box-shaped second yoke provided under the ferrite material for forming a magnetic closed circuit with the first yoke; and a plurality of chip capacitors with a first electrode and a second electrode, the plurality of chip capacitors being installed in the second yoke, wherein one of the first electrodes and the second electrodes is electrically connected to the second yoke, the other of the first electrodes and second electrodes is electrically connected to the central conductors, the second yoke has at least one window for exposing a majority of the surface area of the one of the first electrodes and the second electrodes, and the one of the first electrodes and the second electrodes can be cut out through the window.

2. A nonreciprocal circuit element comprising:

a flat-shaped ferrite material;

first, second, and third central conductors that are provided on one another sandwiching dielectrics and that are crossing one another, the first, second, and third central conductors being provided on the ferrite material;

a magnet provided on the first to third central conductors;

a box-shaped first yoke covering the magnet;

a box-shaped second yoke provided under the ferrite material for forming a magnetic closed circuit with the first yoke; and a plurality of chip capacitors with a first electrode and a second electrode, the plurality of chip capacitors being installed in the second yoke, wherein one of the first electrodes and the second electrodes is electrically connected to the second yoke, the other of the first electrodes and second electrodes is electrically connected to the central conductors, the second yoke has at least one window for exposing the one of the first electrodes and the second electrodes, and the one of the first electrodes and the second electrodes can be cut out through the window, the one of the first electrodes and the second electrodes is soldered to the second yoke and the other of the first electrodes and second electrodes is soldered to the central conductors, and the second yoke has a base and a sidewall extending from the base in a direction perpendicular to the base, and the one of the first electrodes and the second electrodes is soldered to the sidewall.

3. A nonreciprocal circuit element according to claim 2, wherein the magnet is installed in the first yoke so that a first block is formed, and the plurality of chip capacitors, the ferrite material, and the central conductors are installed in the second yoke so that a second block is formed, and the first and second blocks are combined together.

4. A nonreciprocal circuit element according to claim 2, wherein the at least one window exposes a majority of the surface area of the one of the first and second electrodes.

5. A nonreciprocal circuit element according to claim 2, wherein the at least one window exposes the surface area of one of the first and second electrodes of the chip capacitors without exposing a resistor.

6. A nonreciprocal circuit element according to claim 2, wherein the at least one window is large enough to permit cutting of the one of the first and second electrodes.

7. A nonreciprocal circuit element comprising:

a flat-shaped ferrite material;

first, second, and third central conductors that are provided on one another sandwiching dielectrics and that are crossing one another, the first, second, and third central conductors being provided on the ferrite material;

a magnet provided on the first to third central conductors;

a box-shaped first yoke covering the magnet;

a box-shaped second yoke provided under the ferrite material for forming a magnetic closed circuit with the first yoke; and a plurality of chip capacitors with a first electrode and a second electrode, the plurality of chip capacitors being installed in the second yoke, wherein one of the first and second electrodes is electrically connected to the second yoke, the other of the first and second electrodes is electrically connected to the central conductors, the second yoke has at least one window for exposing the one of the first and second electrodes, and the one of the first and second electrodes can be cut out through the window, the one of the first and second electrodes is soldered to the second yoke and the other of the first and second electrodes is soldered to the central conductors, and the second yoke has a base and a sidewall extending from the base in a direction perpendicular to the base, and the one of the first and second electrodes is soldered to the sidewall.

8. A nonreciprocal circuit element according to claim 7, wherein the magnet is installed in the first yoke so that a first block is formed, and the plurality of chip capacitors, the ferrite material, and the central conductors are installed in the second yoke so that a second block is formed, and the first and second blocks are combined together.

9. A nonreciprocal circuit element according to claim 7, wherein the one of the first and second electrodes, which is soldered to the second yoke, is exposed at the window.

10. A nonreciprocal circuit element according to claim 9, wherein the second yoke has a base and a sidewall extending from the base in a direction perpendicular to the base, and the one of the first and second electrodes is soldered to the base.

* * * * *